United States Patent [19]

Sanneman et al.

[11] 4,004,351

[45] Jan. 25, 1977

[54] GRAIN DRYING APPARATUS

[75] Inventors: Douglas D. Sanneman; Ernest Stalder, both of Clay Center; Robert C. Chaffee, Green, all of Kans.

[73] Assignee: Gilmore-Tatge Manufacturing Co., Inc., San Francisco, Calif.

[22] Filed: July 28, 1975

[21] Appl. No.: 599,892

[52] U.S. Cl. ..... 34/52; 34/56; 34/168; 34/174; 214/17 A; 214/302; 222/54

[51] Int. Cl.[2] ..... F26B 17/00

[58] Field of Search ..... 34/52, 56, 168, 174, 34/176; 214/17 A, 17 CA, 17 DA, 302; 222/54

[56] References Cited

UNITED STATES PATENTS

| | | | |
|---|---|---|---|
| 2,170,346 | 8/1939 | Dickey | 122/448 S |
| 3,053,522 | 9/1962 | Applegate | 34/174 |
| 3,092,472 | 6/1963 | Figley | 34/174 |
| 3,274,699 | 9/1966 | Naylor | 34/56 |
| 3,313,040 | 4/1967 | Mathews | 34/56 |
| 3,400,466 | 9/1968 | McClaren | 34/56 |

*Primary Examiner*—John J. Camby
*Assistant Examiner*—Larry I. Schwartz
*Attorney, Agent, or Firm*—John A. Hamilton

[57] ABSTRACT

A grain drying apparatus including a body member into which grain is fed, within which heated air passes through the grain bed to dry it, and from which it is discharged by a metering device, the retention time of the grain in the drying zone being determined by its rate of discharge, the discharge rate of the metering device being variable, and a modulating control system for regulating the metering device to vary its discharge rate in generally direct ratio to grain temperature attained within the drying zone, whereby continuous discharge of grain at a predetermined moisture content is obtained despite variations in the moisture content of the grain supplied to the drying zone.

4 Claims, 7 Drawing Figures

GRAIN DRYING APPARATUS

Figure 1:
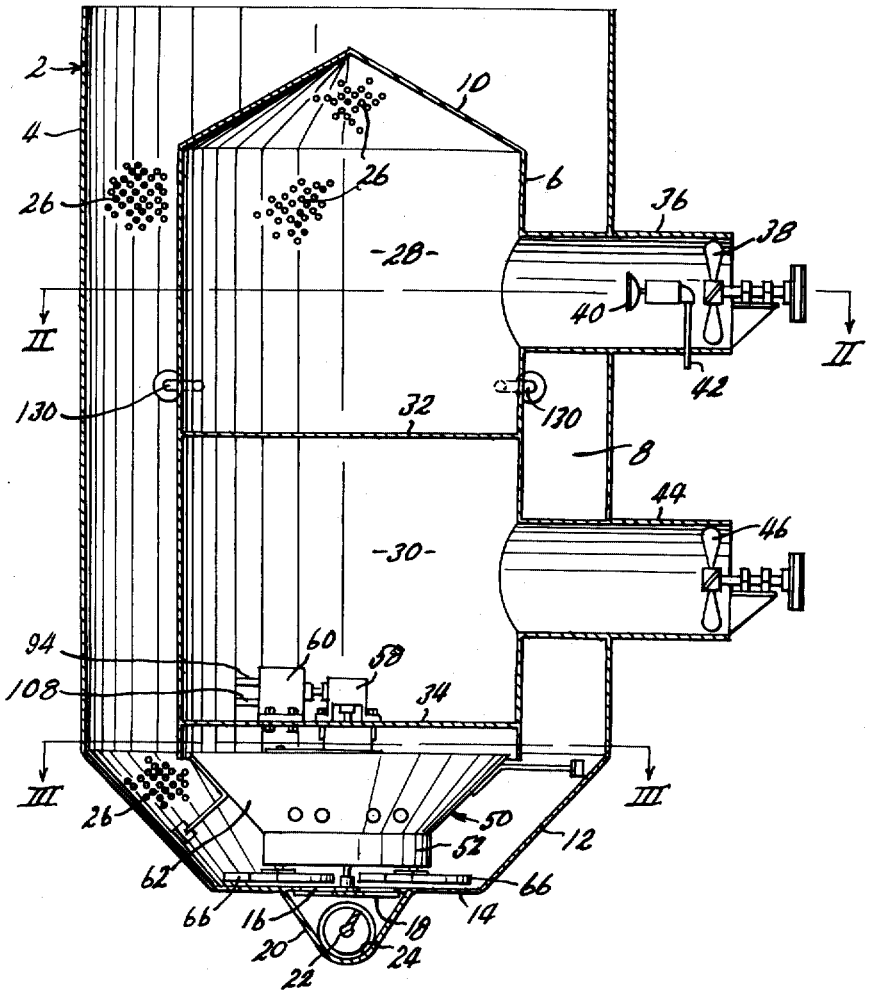

This invention relates to new and useful improvements in grain drying apparatus, and has particular reference to a grain drying machine of the continuous type, that is, a machine in which the grain moves continuously into the machine, traverses a drying zone one time only, within which it is subjected to drying currents of hot air, and then discharged from the machine, as distinguished from recirculating machines, in which the grain is repeatedly recirculated through a drying zone.

In machines of the recirculating type, discharge of grain at a uniform moisture content may be obtained despite variations in the moisture content of the entering grain by continuing the grain recirculation in a closed circuit path until it is dried to the desired degree, however many cycles may be required, checking the grain moisture content at some strategic point in the machine continuously, before allowing the grain to be discharged from the machine. In some cases, the grain moisture content may be checked indirectly by monitoring its temperature, since presuming the drying air to be supplied at a uniform rate and temperature, the degree to which the grain is dried will be generally proportionate to the temperature to which the grain is elevated in the drying zone, a higher temperature indicating that a greater proportion of the moisture has been removed from the grain. However, this system of course cannot be followed in continuous process machines, wherein the grain passes through a drying zone only a single time, and other means must be found for insuring discharge of grain at a desired and relatively uniform moisture content.

Generally, this result may be obtained in continuous process machines in either of two different manners, one by varying the temperature or volume of the drying air to which the grain is subjected as it moves through the drying zone at a uniform rate of travel, and the other by varying the rate of travel of the grain within the drying zone to vary its time of exposure to a flow of drying air which is uniform in volume and temperature, with the variable factors in either case being modulated by some sensing means responsive to the moisture content of the grain at a selected station in the drying zone to produce a drying rate which will cause discharge of grain at a uniform moisture content despite variations of moisture content of the grain entering the machine. As stated above, the sensing device may measure moisture content directly, or indirectly by response to its temperature.

The primary object of the present invention is the provision of a grain drying apparatus in which the grain passes through a drying zone in which it is subjected to a drying flow of hot air supplied at a uniform rate and temperature, and including control means operable to vary the time of retention of the grain in the drying zone in generally inverse ratio to the grain temperature at a strategic point or points in the drying zone, so that the grain is retained for a longer time if its lower temperature indicates that it has not been dried to the desired degree, and so that the grain is retained for a shorter time if its higher temperature indicates that it has been overdried. The control means is adjustable and of a modulating type, whereby presuming that a load of grain of uniform moisture content is being treated, it will pass the grain through the drying zone at a uniform rate producing the desired lower moisture content at the discharge point. Regulation of the retention time, rather than of air flow volume or temperature, and the use of a temperature-responsive sensing device, rather than one requiring direct measurement of moisture content, permit the use of far simpler, less complex and less expensive equipment.

Another object is the provision of a grain drying apparatus of the character described in which the grain moves downwardly through a drying chamber and is discharged from the lower end thereof by gravity, the adjustment of retention time being obtained by a metering device operable to control the rate of grain discharge from the lower end of said chamber, being operable to produce a variable discharge rate regulated by said control means in response to grain temperature in selected zones of the drying chamber.

A further object is the provision of a grain drying apparatus of the character described wherein means are provided for by-passing the modulating control system to provide a maximum grain discharge rate whenever desired, for example to empty the machine of grain.

A still further object is provision of a control system which is basically hydraulic in nature, and may consist virtually entirely of commercially available and relatively inexpensive components.

Other objects are simplicity and economy of construction, and efficiency and dependability of operation.

Figure 2:
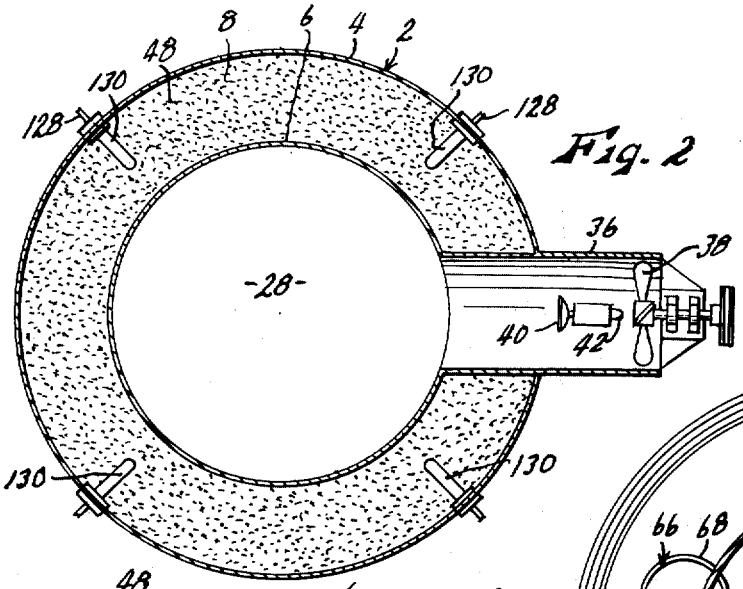
Figure 3:
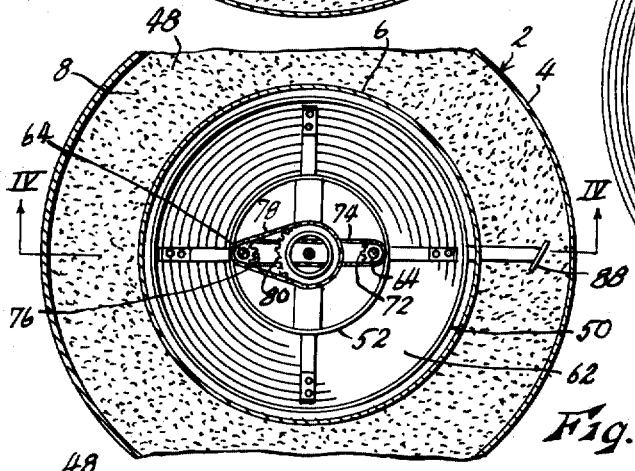
Figure 5:
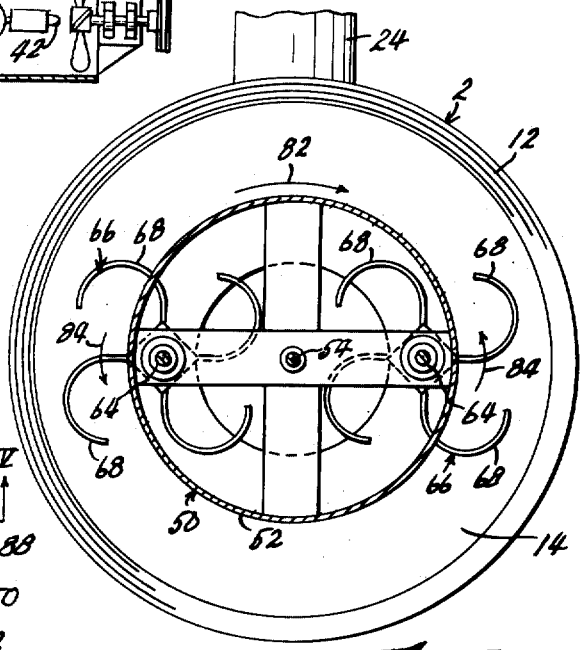
Figure 4:
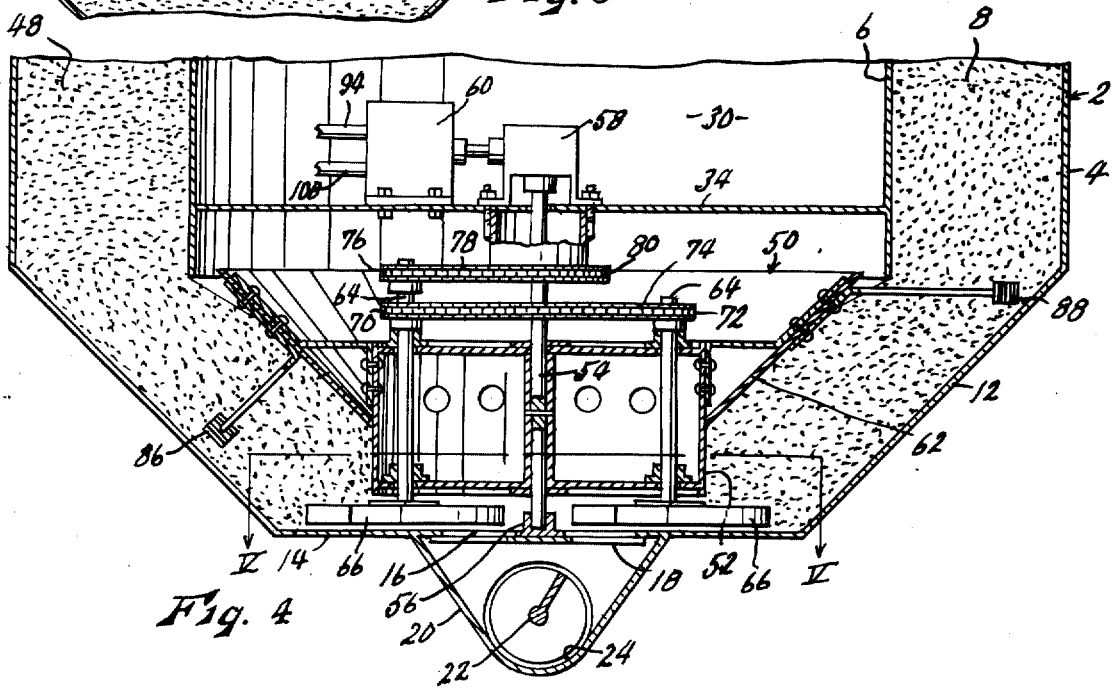
Figure 6:
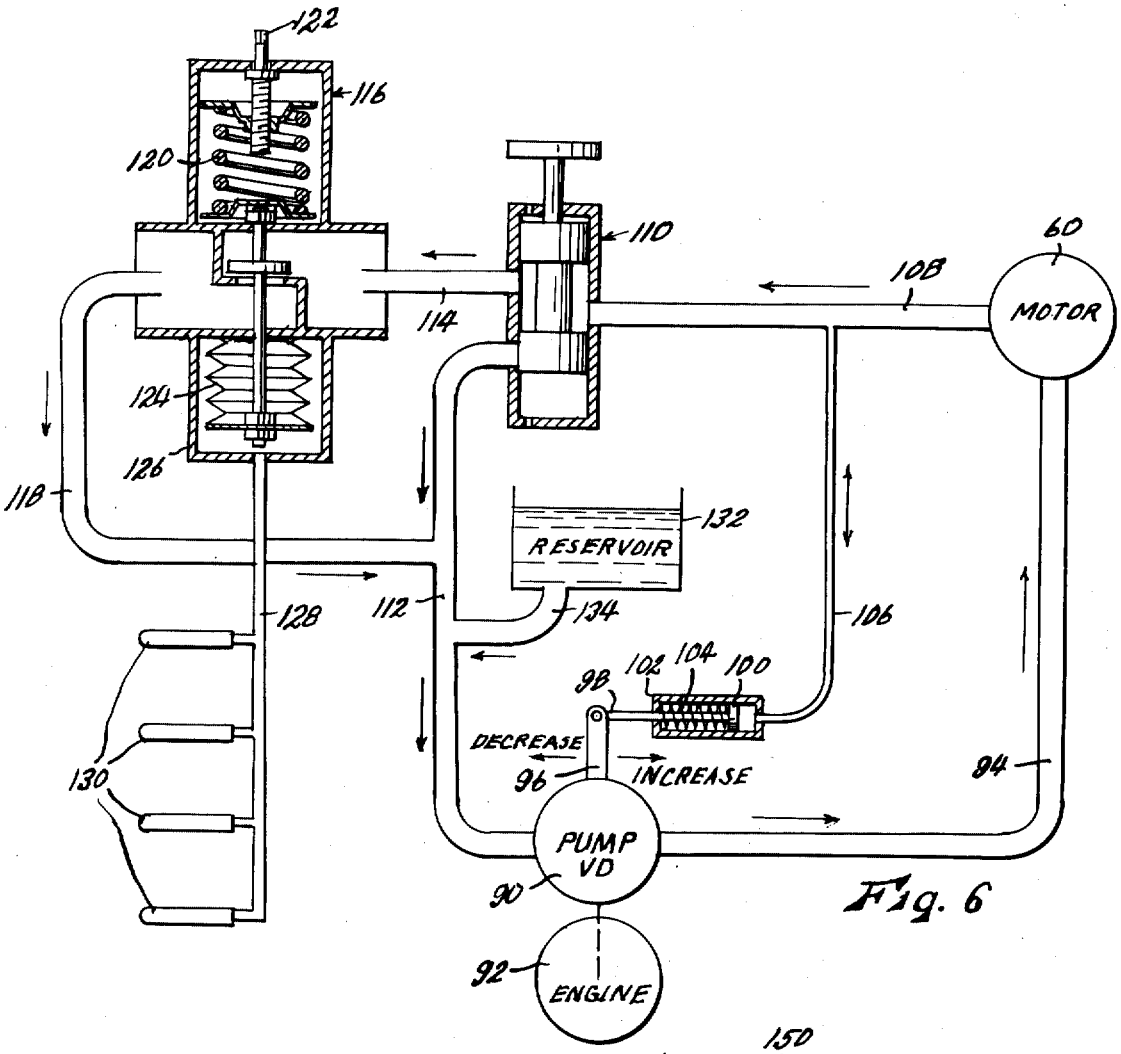
Figure 7:
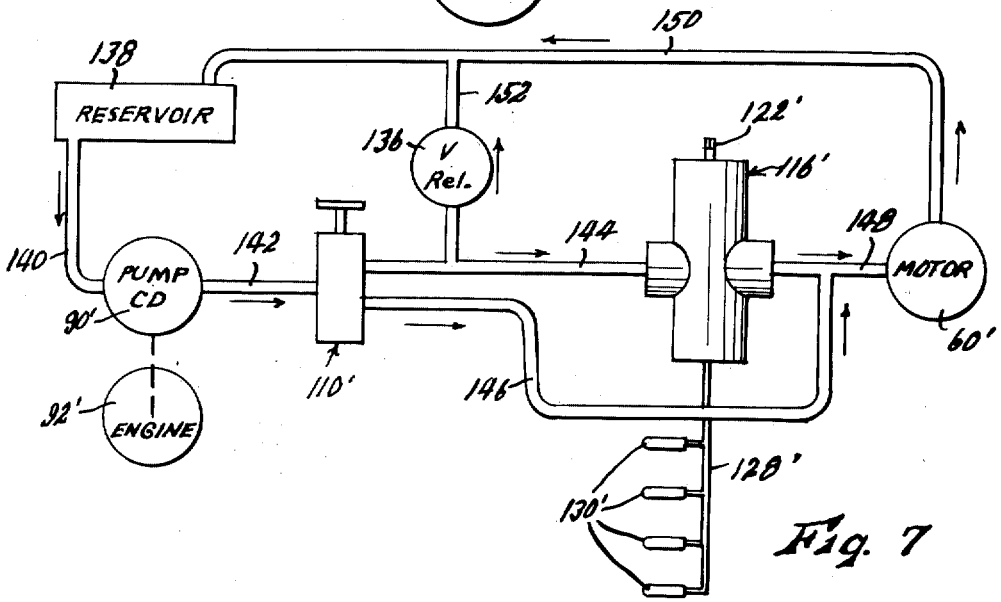

With these objects in view, as well as other objects which will appear in the course of the specification, reference will be had to the accompanying drawing, wherein:

FIG. 1 is a vertical sectional view of a grain drying apparatus embodying the present invention, FIG. 2 is a sectional view taken on line II—II of FIG. 1, showing the grain being dried, FIG. 3 is a sectional view taken on line III—III of FIG. 1, partially broken away, FIG. 4 is an enlarged, fragmentary sectional view taken on line IV—IV of FIG. 3, FIG. 5 is a fragmentary sectional view taken on line V—V of FIG. 4, with the grain omitted, FIG. 6 is a schematic diagram of a preferred control system for the apparatus, and FIG. 7 is a schematic diagram of a modified control system for the apparatus.

Like reference numerals apply to similar parts throughout the several views, and the numeral 2 applies generally to the body assembly of the drying apparatus. Said body includes an outer vertical cylindrical tube 4 and an inner cylindrical tube 6 disposed coaxially within the outer tube and being of smaller diameter than said outer tube, whereby to form an annular grain chamber 8 therebetween. Outer tube 4 is positioned and supported above the ground in the position shown in FIG. 1, and inner tube 6 is positioned within the outer tube, by suitable framing structure, not shown. The inner tube is provided with a top wall 10 of inverted conical form, and outer tube 4 is provided with a downwardly convergent frustro-conical hopper bottom 12, the lower end of which is closed by a horizontal bottom wall 14 having a circular hole 16 formed centrally therein, in which is mounted a spider 18 affixed therein which does not materially obstruct the flow of grain through said hole. Hole 16 opens downwardly into a hopper 20 from which grain is removed horizontally to any desired point of delivery by means of an auger 22 operable in a horizontal auger tube 24, said auger being driven by any suitable means, not shown.

Inner and outer tubes 6 and 4, as well as top wall 10 and hopper bottom 12, are all formed of sheet metal perforated over substantially their entire areas, as indicated at 26 in FIG. 1, the perforations passing air freely, but being too small to pass the kernels of the grain. Inner tube 6 is divided internally about midway of its height into an upper plenum chamber 28 and a lower plenum chamber 30 by means of an imperforate horizontal wall 32. Disposed at the lower end of said inner tube is a floor structure 34 which need not be an imperforate wall, but may constitute an openwork spider. An upper air tube 36 extends horizontally and radially through outer tube 4 and inner tube 6, opening radially at its inner end into upper plenum chamber 28, and opening to the atmosphere at its outer end. Disposed within its outer end portion is a blower fan 38 which is driven by any suitable means, not shown, to deliver large quantities of air inwardly through tube 36 to chamber 28, and a burner 40, supplied with gas or other fuel through a fuel pipe 42, by means of which said air is heated. A lower air tube 44 similar to upper tube 36 opens inwardly into chamber 30 below wall 32, and also carries a blower 46 operable to deliver air to chamber 30, but no burner, whereby said air is not heated.

Thus if blowers 38 and 46, and burner 40, are in operation, and grain 48 is poured into the upper end of outer tube 4 to fill grain chamber 8 and cover the top wall 10 of the inner tube, hot air delivered to plenum chamber 28 by blower 38 will be forced outwardly through the wall of grain surrounding said plenum chamber, and said grain will be dried by said hot air currents. As long as the grain wall is of generally uniform thickness, all portions of the grain will be subjected to generally equal amounts of hot air. The means for introducing grain into the apparatus, in itself, forms no part of the present invention and is not shown.

Grain escapes at some rate through hole 16 in the hopper bottom of the outer tube, and the grain therefore moves gradually downwardly through grain chamber 8. As the grain passes below the level of horizontal wall 32, it is subjected to a permeating flow of unheated air delivered to lower plenum chamber 30 by blower 46. This cools the grain before it is discharged through hole 16 of the hopper bottom, and is considered desirable since it tends to prevent the subsequent re-condensation of moisture on the grain which could occur if the grain were discharged hot.

With the apparatus as thus far described, the grain would, if supplied to the upper end of chamber 8 at variable degrees of moisture content, also be discharged at hopper hole 16 at variable degrees of moisture content, presuming that the drying air is supplied at a uniform rate and temperature, and that auger 22 operates at a uniform speed, since all of the grain would be exposed to the same drying action regardless of its original moisture content. That is, grain which was originally quite wet would be discharged before reaching its desired degree of dryness, while grain which was originally comparatively dry would be over-dried. The prevention of this occurrence, whereby grain may be discharged at a uniformly low moisture content despite variations of the moisture content of the entering grain, is the prime object of the present invention. Generally, this object is accomplished by the provision of a grain flow metering device operable to regulate the rate at which grain passes through the apparatus, and automatically operable modulating means for controlling the metering device in response to the moisture content of the grain at some strategic point in the apparatus, preferably of course at a point where the drying action is substantially completed.

The metering device utilized is indicated generally at 50, and includes a cylindrical rotor 52 coaxial with tubes 4 and 6, being of smaller diameter than inner tube 6 and disposed between the lower end of tube 6 and bottom wall 14 of hopper bottom 12. Said rotor is affixed on a vertical shaft 54 coaxial therewith, said shaft being journalled at its lower end in a bearing 56 mounted on spider 18, and being driven at its upper end by a geared speed reduction unit 58 driven by a hydraulic motor 60, said motor and reducer being mounted on spider 34 at the lower end of inner tube 6. A frustro-conical wall 62 is disposed coaxially with rotor 52, being affixed at its smaller lower end to said rotor whereby to rotate therewith, and projecting upwardly into the lower end of inner tube 6.

The diameter of rotor 52 is greater than the diameter of discharge hole 16 of hopper bottom wall 14, and is concentric therewith and spaced thereabove. A pair of shafts 64 are carried rotatably by the rotor, said shafts being parallel with shaft 54 and equidistantly spaced at diametrically opposite sides thereof. Each of shafts 64 has affixed to its lower end a scoop wheel 66 best shown in FIGS. 4 and 5, each including a series of arms 68 extending first radially from shaft 64, then curved inwardly in a re-entrant loop. Said arms are of such radial extent that each extends outwardly from rotor 52, beneath the lower edge of said rotor and over hopper floor 14, at some points in the rotation thereof, and inwardly over hole 16 of floor 14 at other points of its rotation. Just above rotor 52, sprocket wheels 70 and 72 are fixed respectively on shafts 64 and operably connected by a sprocket chain 74. Another sprocket wheel 76 is fixed on one of shafts 64, and is operably connected by a sprocket chain 78 to a sprocket 80 fixed on spider 34 coaxially with shaft 54. Thus as rotor 52 is turned in the direction of arrow 82 in FIG. 5 when shaft 54 is turned by hydraulic motor 60, scoop wheels 66 are turned in a relatively reverse direction, as indicated by arrows 84, by the chain and sprocket power drive described. Referring to FIG. 4, it will be seen that when the apparatus is charged with grain 48 as shown, rotor 52 blocks the grain against direct gravity flow to discharge hole 16 of floor 14. However, as rotor 52 is turned by motor 60, scoop wheels 66 also turn, the loops of their arms 68 filling with grain while they are extended radially outwardly from the rotor, then transporting said grain within the rotor and over hole 16, through which the grain then passes by gravity to hopper 20 and auger 22. It will be readily apparent that a power drive for the scoop wheels, as shown, is not essential, since said wheels will be turned in the direction shown even if shafts 64 of the scoop wheels are merely free turning, but not power driven. This occurs since the wheel arms are relatively heavily loaded by the pressure and weight of the grain when they project outwardly from the rotor, and only relatively lightly loaded when they are disposed inside of the rotor, so that they are turned by the load imposed thereon by the grain itself. However, power drive of the scoop wheels is preferred, both because it provides for grain discharge at a more uniform rate, and also because it reduces any likelihood that rotation of the scoop wheels might become clogged or jammed by weeds or the like entrained in the grain. Grain stirring arms 86 and 88, secured to conical wall 62 of the rotor, extend outwardly into the grain wall surrounding the rotor to agitate and stir said grain, thereby reducing any likelihood of jamming or "bridging" of the grain, which could inhibit free flow of the grain and produce inequalities of grain flow rate in different peripheral portions of the grain wall.

The rate of grain discharge through hole 16, and hence the time the grain is retained in the grain wall surrounding upper hot air plenum chamber 28, which in turn determines the degree to which the grain is dried, is thus determined by the speed of operation of hydraulic motor 60, which controls the rotation rate of rotor 52 and scoop wheels 66. Automatic modulating regulation of the speed of motor 60, whereby discharge of grain at a uniform moisture content is obtained despite variations of the moisture content of the grain entering the top of the device, is obtained by control systems for the hydraulic motor shown by way of example in FIGS. 6 and 7.

In FIG. 6, motor 60 is driven by a hydraulic pump 90 which is driven by a gasoline engine 92 or other prime mover to deliver fluid to said motor through a conduit 94. The speed of motor 60 varies directly with the rate of fluid supply thereto. Engine 92 may operate at a constant speed, but pump 90 is of a variable delivery type, having a control lever 96 operable when moved in one direction to increase its fluid delivery rate, and when moved in the opposite direction to decrease its delivery rate. Pumps of this general type are well known in the art, and its specific structure is therefore not shown. In a piston-type pump, for example, movement of lever 96 may be utilized to vary the displacement of the pump pistons. Lever 96 is moved by a control rod 98 connected to a piston 100 operable in a fluid cylinder 102, said piston being biased in a direction to increase the delivery rate of the pump by means of a spring 104, while the opposite end of the cylinder is interconnected by a conduit 106 into the exhaust conduit 108. Conduit 108 is also connected to the input side of a manually operable selector valve 110, by means of which the fluid exhaust from the motor may be selectively set to deliver the motor exhaust either directly back to the suction side of pump 90 through conduit 112, or (when set as illustrated) to deliver the motor exhaust fluid through a conduit 114 to a thermostatically operable control valve 116, and thence through conduits 118 and 112 to the pump. Valve 116 is resiliently biased toward a minimum-open position by means of spring 120 the tension of which can be adjusted by turning a screw 122, and movable to more widely open positions by fluid pressure on a bellows 124 carried within a chamber 126 formed by the valve body. Chamber 126 is connected by a capillary tube 128 to a plurality of sealed sensor bulbs 130 which are disposed within grain chamber 8 of the body assembly 2, preferably in regularly spaced angular relationship around said chamber, and just above the level of bottom wall 32 of upper plenum chamber 28, although other positions of the sensor bulbs can be used. Thus the degree to which valve 116 is opened is directly proportionate to the grain temperature to which bulbs 130 are subjected, since they determine the fluid pressure exerted on valve bellows 124. The hydraulic fluid system is essentially a closed circuit, except that a fluid reservoir 132 may be utilized which is connected by conduit 134 to pump return conduit 112, in order to replenish any fluid loss by leakage.

Operation of the device as described takes advantage of the fact that, given a supply of drying air from blower 38 at a substantially uniform rate and temperature, the moisture content of the grain during drying will be reliably indicated by its temperature, the temperature increasing as more moisture is removed, and being substantially uniform for any given moisture content. Thus if the grain, in settling downwardly through grain chamber 8, reaches sensor bulbs 130 at a temperature higher than that for which spring 120 has been set, the higher pressure in bulbs 130 opens valve 116 wider. This reduces the pump back pressure in exhaust conduit 108 and in conduit 106, allowing spring 104 to move piston 100 to the right (as shown), and moving pump control lever 96 to increase the delivery rate of pump 94 to increase the operating speed of hydraulic motor 60 and the rate at which metering device 50 discharges grain. The speed of travel of the grain through the drying zone is thus increased (or its retention time therein reduced), so that subsequent grain is subjected to the drying air for a shorter time period. On the other hand, if grain reaches bulbs 130 at too low a temperature, indicating that it has not been dried to the desired degree, valve 116 tends to move to a closed position, which increases the pressure in conduits 108 and 106, forcing piston 100 to the left against spring 104 to adjust pump 90 to a lower delivery rate, so that motor 60 and metering device 50 operate more slowly, which increases the retention time of grain in the drying zone and the duration of its exposure to the hot air flow. Eventually, a condition of balance will be reached at which pump 90 will operate at a constant delivery rate to produce a rate of grain flow through the drying zone proper to discharge the grain accurately at a predetermined moisture content. If grain at some other moisture content is added to the machine, the modulating system will seek and find a discharge rate balanced to discharge the grain at the same moisture content as before. The moisture content at discharge is predetermined by turning adjusting screw 122, which by experimentation may be calibrated to make the setting thereof a very simple operation.

When starting the machine, a quantity of grain will of course pass through the machine before the condition of balance described above is attained. This grain may be recycled through the dryer to bring it to the desired moisture content. Selector valve 110 may be manually set to cause the fluid flow to by-pass thermostatic control valve 116, thereby producing a maximum operating speed of motor 60. This may be desired, for example, to exhaust the entire machine of grain in the least possible time, as when shutting the machine down. While a single sensor bulb 130 could be used in place of the four shown, the use of a plurality thereof at different angular points of the grain wall provides an "averaging" of the temperatures at the sensing points, and is therefore conducive to a generally more accurate overall operation, since the grain temperatures in different portions of the same grain bed may vary to some slight degree.

In FIG. 7 there is shown a control system for the device which is generally similar to that shown in FIG. 6, corresponding elements bearing corresponding primed numerals, except that the pump 90' therein is of a type having a constant rate of fluid delivery, and that control valve 116', which corresponds in all pertinent respects to valve 116 of FIG. 6, is disposed in the supply line rather than the exhaust line of hydraulic motor 60', a pressure relief valve 136 being interconnected between the upstream side of valve 116' and the exhaust side of the motor. Pump 90' receives hydraulic fluid from a fluid reservoir 138 through a conduit 140, and delivers it through conduit 142 to a selector valve 110' corresponding to valve 110 of FIG. 6, being manually settable to deliver fluid selectively either through a conduit 144 to control valve 116', or to a conduit 146 by-passing said control valve to a conduit 148 connecting the outlet of valve 116' to the inlet of hydraulic motor 60'. The outlet of the motor is connected to reservoir 138 by conduit 150. Relief valve 136 is disposed in a conduit 152 interconnecting conduits 144 and 150, and as well understood in the art, opens to permit fluid flow in the direction of its flow arrow in an amount directly proportional to fluid pressure at its inlet side.

Thus, when sensor bulbs 130' detect a grain temperature indicating over-drying, they cause valve 116' to open wider, allowing a greater proportion of the pump output to be delivered to motor 60' to operate said motor at a higher speed to pass the grain through the drying zone at a faster rate, while the concurrent pressure drop in conduit 144 causes throttling of relief valve 136 so that a smaller proportion of the pump output by-passes the motor. On the other hand, if sensor bulbs 130' detect a lower grain temperature indicating insufficient drying of the grain, they allow control valve 116' to close partially, decreasing the rate of fluid delivery to motor 60' to slow the operation of metering device 50 and increase the time of retention of the grain in the drying zone, while the increased back pressure in conduit 144 causes relief valve 136 to open more widely to by-pass a greater proportion of the pump output around the motor. Thus, providing that control valve 116' has been properly adjusted by turning screw 122' thereof, the apparatus will discharge grain at a uniformly accurate moisture content regardless of variations in the moisture content of the grain entering the apparatus.

The control system shown in FIG. 7 is somewhat simpler than that shown in FIG. 6, and also readily allows operation of the apparatus by an ordinary farm tractor equipped with a hydraulic system for operating accessories. Engine 92' may constitute the power plant of the tractor, and pump 90' and reservoir 138 may be elements of the tractor hydraulic system. Most tractor hydraulic systems, as a matter of fact, even include pressure relief valves which can perform the function of relief valve 136. The tractor power plant may also, by means of its usual power take-off, be utilized to operate blowers 38 and 46, as well as auger 22.

While we have shown and described certain specific embodiments of our invention, it will be readily apparent that many minor changes of structure and operation could be made without departing from the spirit of the invention.

What we claim as new and desire to protect by Letters Patent is:

1. A grain drying apparatus comprising:

a. a body assembly through which grain to be dried passes in a continuous flow pattern, said assembly including a drying zone through which said grain passes one time only, b. means operable to pass a permeating flow of heated air through said grain within said drying zone, whereby moisture is removed from said grain, said heated air being supplied at a generally uniform rate and temperature, whereby the moisture content to which said grain is reduced within said drying zone is rendered generally inversely proportional to the temperature to which said grain is elevated within said drying zone, c. a mechanically operable grain metering device operable to regulate the rate of flow of said grain through said drying zone, and hence its retention time within said drying zone, the retention time of the grain within the drying zone being generally inversely proportionate to the speed of operation of said metering device, and d. modulating control means operable responsively to the temperature to which said grain is elevated in said drying zone to regulate the speed of operation of said metering device to produce a variable rate of grain flow through said drying zone such that grain is elevated to a generally uniform temperature within said drying zone despite variations in the moisture content of grain entering said drying zone, said control means comprising a hydraulic motor operable to drive said metering device and having an essentially closed operating hydraulic circuit, the operating speed of said motor being generally proportionate to the rate at which hydraulic fluid is supplied thereto, a variable delivery hydraulic pump in said circuit and operable to deliver fluid to said motor, a control valve disposed in said circuit downstream from said motor, thermostatic means responsive to the temperature attained by the grain within the drying zone to permit fluid flow through said valve generally directly proportionate to said temperature, and means operable to vary the delivery rate of said pump continuously, and being responsive to fluid pressure in said hydraulic circuit between said motor and control valve to vary the delivery rate of said pump in generally inverse ratio to said pressure.

2. An apparatus as recited in claim 1 wherein said hydraulic circuit includes a conduit by-passing said control valve, and with the addition of a manually operable selector valve operable to return fluid exhausting from said motor selectively to said pump either through said control valve, or directly to said pump through said by-pass conduit.

3. A grain drying apparatus comprising:

a. a body assembly through which grain to be dried passes in a continuous flow pattern, said assembly including a drying zone through which said grain passes one time only, b. means operable to pass a permeating flow of heated air through said grain within said drying zone, whereby moisture is removed from said grain, said heated air being supplied at a generally uniform rate and temperature, whereby the moisture content to which said grain is reduced within said drying zone is rendered generally inversely proportional to the temperature to which said grain is elevated within said drying zone, c. a mechanically operable grain metering device operable to regulate the rate of flow of said grain through said drying zone, and hence its retention time within said drying zone, the retention time of the grain within the drying zone being generally inversely proportionate to the speed of operation of said metering device, and d. modulating control means operable responsively to the temperature to which said grain is elevated in said drying zone to regulate the speed of operation of said metering device to produce a variable rate of grain flow through said drying zone such that grain is elevated to a generally uniform temperature within said drying zone despite variations in the moisture content of grain entering said drying zone, said control means comprising a hydraulic motor operable to drive said metering device and having an operating hydraulic circuit, the operating speed of said motor being generally proportionate to the rate at which hydraulic fluid is supplied thereto, a hydraulic pump having a constant delivery rate disposed in said hydraulic circuit and operable to supply fluid to said motor, a control valve interposed in said hydraulic circuit intermediate said pump and motor, thermostatic means responsive to the temperature attained by the grain within the drying zone to permit fluid flow through said control valve in generally direct ratio to said temperature, a conduit by-passing said motor and control valve in said hydraulic circuit, and a pressure relief valve interposed in said by-pass conduit and operable to permit a by-pass fluid flow generally directly proportionate to the fluid pressure in said hydraulic circuit intermediate said pump and said control valve.

4. An apparatus as recited in claim 3 with the addition of a second conduit in said hydraulic circuit by-passing said control valve but not said motor, and with the addition of a manually operable selector valve operable to deliver the output of said pump selectively either to said motor through said control valve, or directly to said motor.

* * * * *